US009483022B1

(12) United States Patent
Avetyan

(10) Patent No.: US 9,483,022 B1
(45) Date of Patent: Nov. 1, 2016

(54) REVERSE CLOCK FACE WITH MOVING DIAL

(71) Applicant: Arshak Avetyan, Burbank, CA (US)

(72) Inventor: Arshak Avetyan, Burbank, CA (US)

( * ) Notice: Subject to any disclaimer, the term of this patent is extended or adjusted under 35 U.S.C. 154(b) by 0 days.

(21) Appl. No.: 14/940,152

(22) Filed: Nov. 13, 2015

(51) Int. Cl.
*G04B 19/247* (2006.01)
*G04B 19/16* (2006.01)
*G04G 21/00* (2010.01)

(52) U.S. Cl.
CPC ..... *G04B 19/247* (2013.01); *G04B 19/16* (2013.01); *G04G 21/00* (2013.01)

(58) Field of Classification Search
CPC .... G04B 19/247; G04B 19/16; G04B 19/06; G04G 21/00
See application file for complete search history.

(56) References Cited

U.S. PATENT DOCUMENTS 340,044 A * 4/1886 Hunter ..... G04B 19/06 368/232
344,423 A * 6/1886 Tragardh ..... G04B 19/06 368/232
652,822 A * 7/1900 Voorheis ..... G04B 19/06 368/232
839,578 A * 12/1906 Giroud ..... G04B 19/06 368/232
1,344,913 A * 6/1920 Long ..... G04B 19/223 368/27
2,081,311 A * 5/1937 Thompson ..... G04F 3/06 194/295
5,917,778 A * 6/1999 James ..... G04B 19/22 368/17

* cited by examiner

*Primary Examiner* — Sean Kayes
(74) *Attorney, Agent, or Firm* — Edwin Tarver

(57) ABSTRACT

A clock face that creatively displays the current time includes an analog clock face having hour markers arranged in a counter-clockwise numerical sequence. An hour hand and a minute hand travel in a counter-clockwise direction around the dial, corresponding to the counter-clockwise hour markers. The dial moves in a clockwise direction to display an hour marker corresponding to the current month at the top of the clock face. The hour hand and the minute hand both move counter-clockwise corresponding to the hour markers while the dial moves in a clockwise direction, enabling the clock face to show the current time and current month at the same time.

10 Claims, 7 Drawing Sheets

REVERSE CLOCK FACE WITH MOVING DIAL

BACKGROUND

1. Field of the Invention

The present invention generally relates to clocks. More specifically, the present invention relates to clock faces with time displayed in an unconventional manner.

2. Related Art

Clocks having analog-type clock faces are popular among consumers, and are a traditional method of displaying time. The standard clock face, including twelve numbered hours evenly spaced around the dial to reflect hours in five minute increments, has remained virtually unchanged since clocks were originally developed.

To provide an interesting and novel time keeping experience, and for variety and entertainment, various clocks have been developed to provide analog-type faces with alternative indicia such as fanciful numbers, objects that slide over the numbers, or even clocks with missing numbers and missing hour indicators. While these clocks provide an interesting clock face design, displaying the time is still conducted in the same manner with an hour hand pointing at the current hour and a minute hand indicating the minute within the hour.

To provide a more interesting time keeping experience alternatives, including modified digital clocks, have also been developed. These apparatus represent time in different configurations of images or objects, creating a challenge to determining the time, which can be interesting. While these clocks may attract and hold a person's interest, they are unrelated to the traditional analog clock face design, and decouple an alternative method of time keeping and display from a traditional clock face design.

Hence, what is needed is an analog clock face that displays the time, but that does so in an alternative, interesting, and attention-getting manner without the limitations of existing time displaying techniques.

SUMMARY

A clock face for creatively displaying the current time is disclosed. The clock face includes an analog-type, circular clock face having a dial, with the dial including hour markers that display twelve hours. The hour markers on the dial typically correspond to the twelve hours (a.m. or p.m.) and are evenly arranged around the dial. Notably, the hour markers are arranged in a counter-clockwise numerical sequence.

An hour hand and a minute hand are configured to travel in a counter-clockwise direction around the dial, corresponding to the counter-clockwise sequence of hour markers. The position of the hour hand reflects the current time proximate each hour marker, and the position of the minute hand reflects the minute of the hour.

The dial is also movable, but in a clockwise direction to display different hour markers. In particular, the dial displays an hour marker corresponding to the current month at the top of the clock face. The dial may also include a non-chronologically related indicia, such as a message or graphic. The indicia preferably has an orientation, such that it can be aligned with a predetermined hour marker, thereby displaying the indicia in a particular orientation during a particular month. The hour hand and the minute hand both move in a counter-clockwise direction corresponding to the hour markers, while the dial spins in a clockwise direction to show the current time and current month at the top of the clock face.

The clock face may include a second hand, also traveling in a counter-clockwise direction to display the current time to the second. It may also include added functionality, such as having a marker to display a particular day of the week. In one embodiment, the dial changes a different color for each day of the week. In another embodiment, the hour marker corresponding to the day (i.e., 1 through 7) is circled.

According to preference, the clock face may be incorporated into a mechanical clock, or may comprise an animated graphic on a screen of an electronic device. In one alternative embodiment, the dial may be preset to display a predetermined hour marker other than twelve in order to correspond to a single particular month over time. In a further embodiment, the dial may be permanently set at the predetermined hour marker.

DETAILED DESCRIPTION

The following description is presented to enable any person skilled in the art to make and use the invention, and is provided n the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
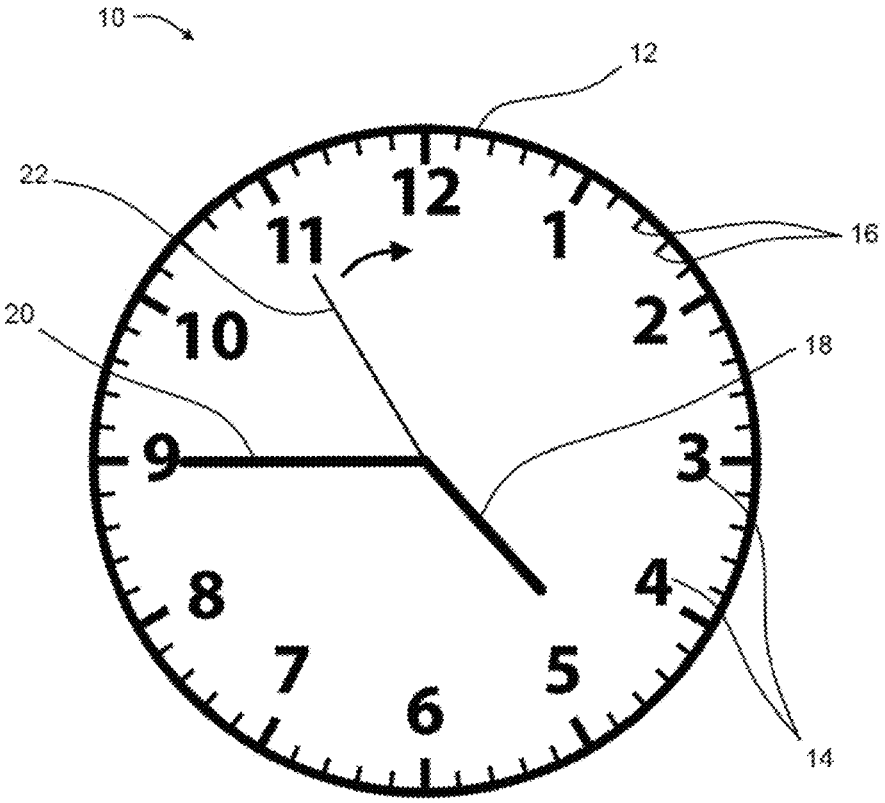
FIGURE 1 (PRIOR ART)
FIG. 1 illustrates a conventional prior art clock face with hands traveling in a clockwise direction.

Referring to FIG. 1, a prior art clock face 10 is shown having features common to the present invention, including a circular dial 12, having twelve equally spaced hour markers 14, the dial 12 divided into sixty equally spaced minute markers 16, with four minute markers 16 per hour marker 14. Time is told by an hour hand 18 pointing at the space between appropriate hour markers 14, and a minute hand 20 pointing at an appropriate minute marker 16. A second hand 22 shows the number of seconds remaining in the minute, rotating in a clockwise direction, wherein seconds also correspond to the minute markers 16. For purposes of clarity, all clock faces 10, 100, 200 (FIGS. 1-7) will be shown reflecting a time of 4:45 (a.m. or p.m.)

Figure 2:
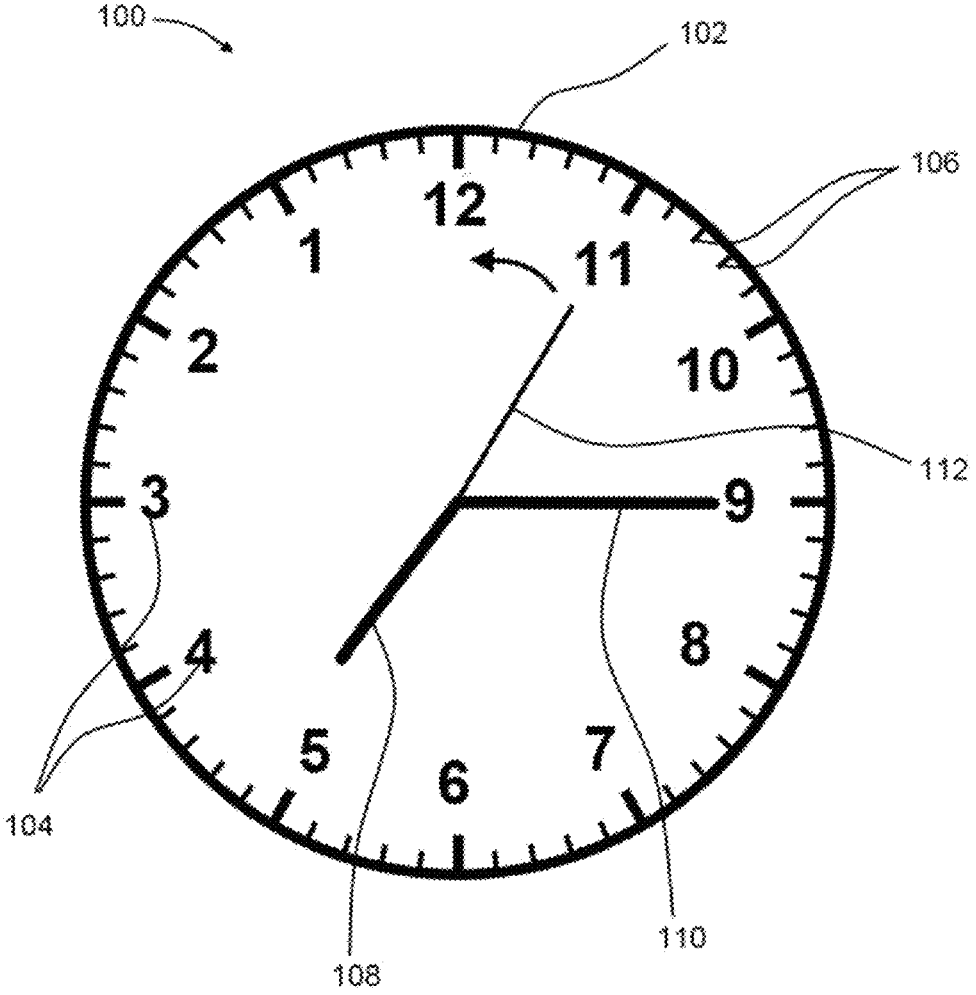
FIG. 2 illustrates a clock face of the current invention wherein the numbers are ascending counterclockwise.

Referring to FIG. 2, a backward-running clock face 100 is shown. The clock face 100 is in all respects similar to the prior art, with elements contained in circular dial 102, except that the hour markers 104 are arranged in reverse order, such that their numeric values ascend in a counterclockwise direction. The hour markers 104 and the minute markers 106 have the same ratios as the prior art shown in FIG. 1. Since the hour markers 104 are reversed, the hour hand 108, minute hand 110, and second hand 112 all run in a corresponding counterclockwise direction.

Figure 3:
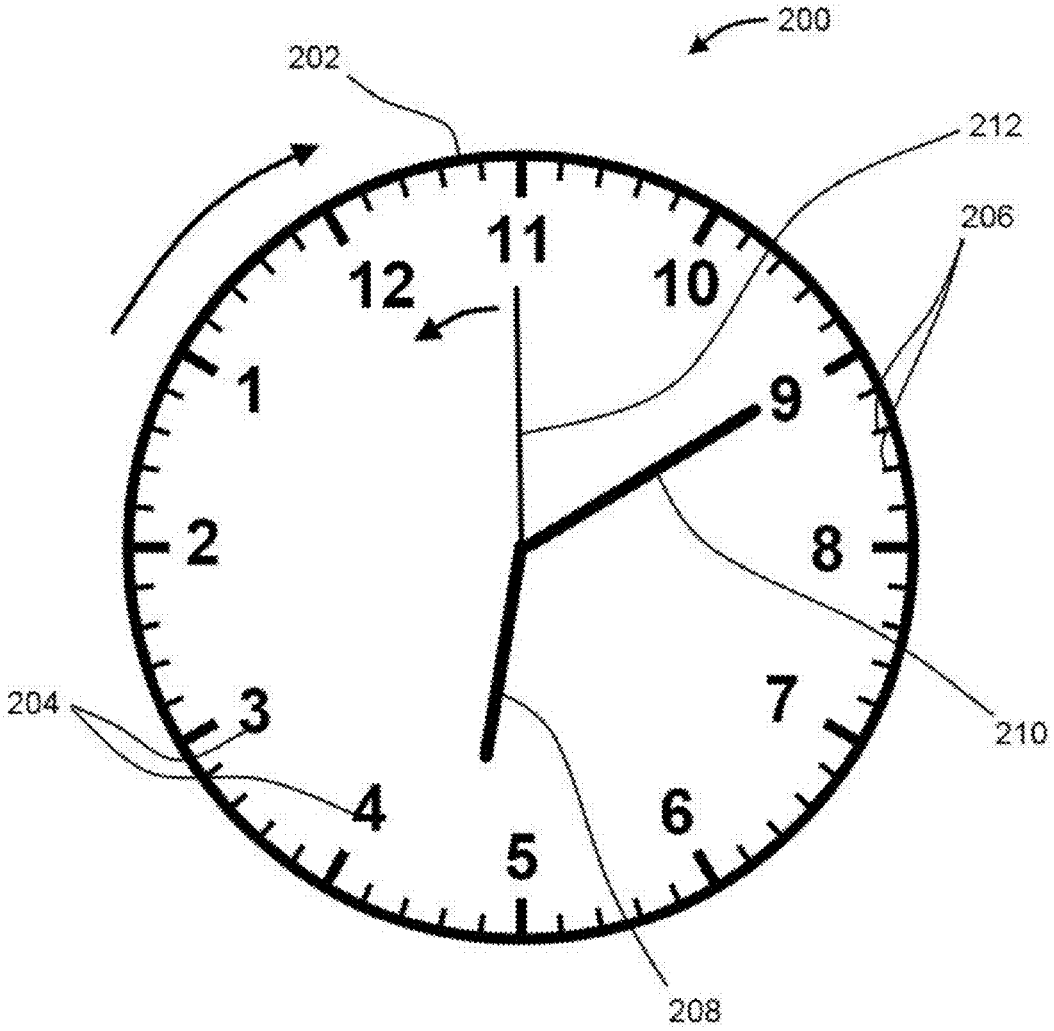
FIG. 3 illustrates the clock face rotating in a counter-clockwise direction.

Referring to FIG. 3, an alternative embodiment backward-running clock face 200 is shown. The clock face 200 includes a dial 202, hour markers 204, and minute markers 206 similar to the other illustrated embodiments. The dial 202 also has an hour hand 208, minute hand 210, and second hand 212 that move according to the arrangement of the hour markers 204 and minute markers 206. This clock face 200, however, shows an additional movement of the dial 202 itself, which re-orients the hour markers 204 according to a particular time. As shown in the illustration, the clock face 200 is turning the dial 202 in a clockwise direction to compensate for the counter-clockwise arrangement of the hour markers 204.

Figure 4:
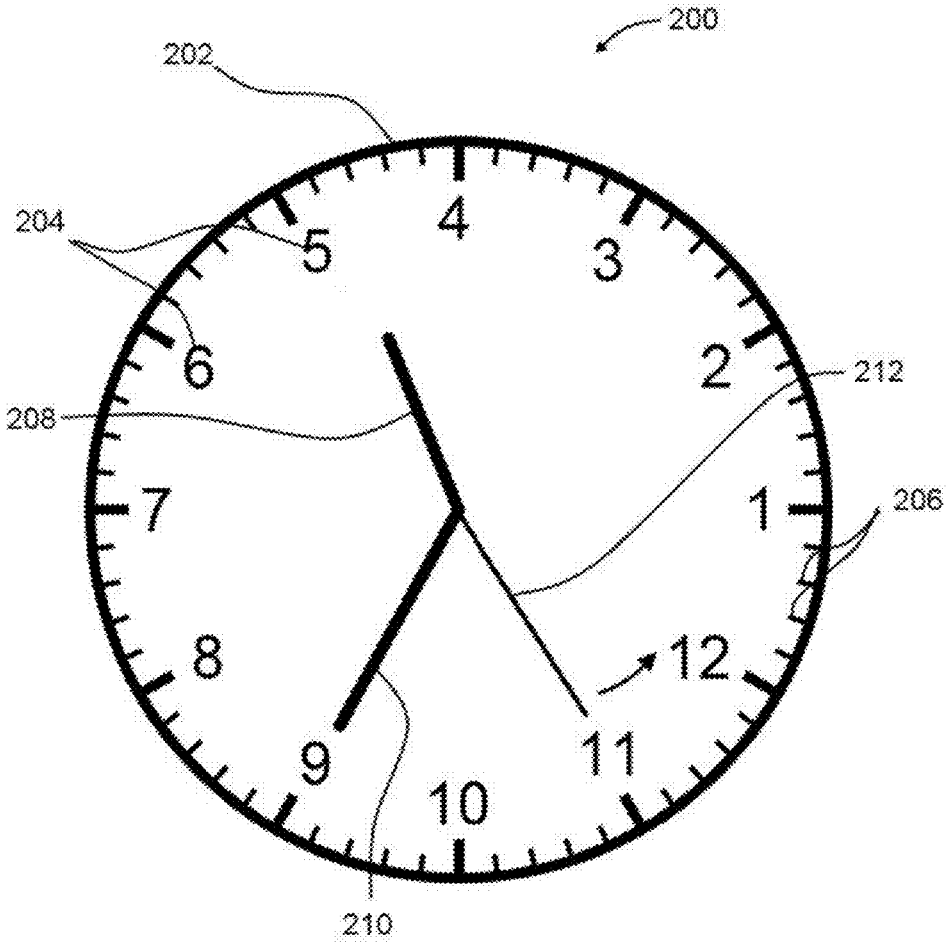
FIG. 4 illustrates the clock face rotated to show the current hour.

Referring to FIG. 4, the alternative embodiment clock face 200 is shown as it would appear at the illustrated time of 4:45. When the 4 o'clock hour occurs, the dial 202 rotates to position the hour marker 204 marked "4" at the top of the clock face 200 (i.e., normally where the hour marker 204 marked "12" would be). The dial 202 remains in this position as the 4 o'clock hour passes, including the illustrated time of 4:45, until 5:00 o'clock, when the dial 202 once again rotates to position the hour marker 204 marked "5" at the top of the clock face 200. In various alternative embodiments, the dial 202 movement may be continuous, such that the hour hand 208 remains in an upward position as the dial 202 rotates, from hour marker 204 to hour marker 204.

Figure 5:
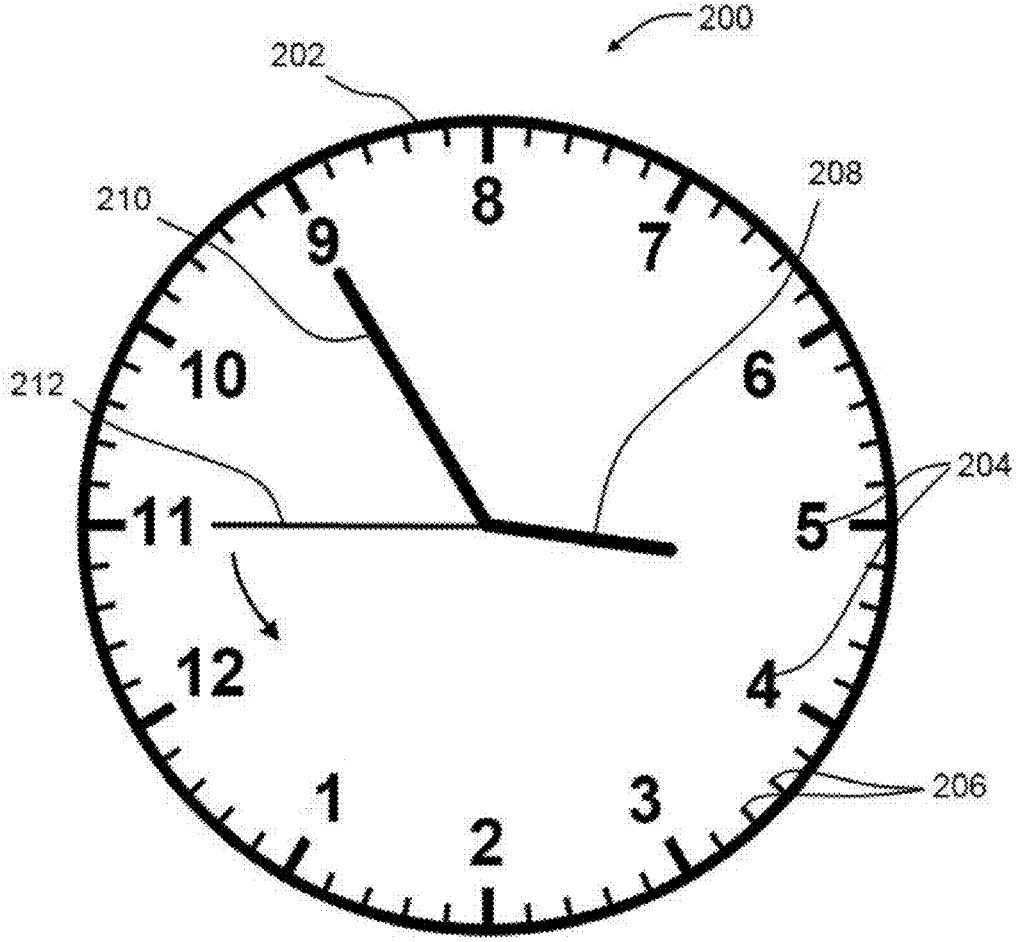
FIG. 5 illustrates the clock face oriented to show a predetermined month.

Referring to FIG. 5, an alternative arrangement is shown, wherein the dial 202 is set so that a particular hour marker 204, in the illustrated embodiment, the hour marker 204 marked "8" is at the top of the clock face 200. In this arrangement, the dial 202 still moves, but instead of corresponding to an hour marker 204, the dial 202 corresponds to one of the twelve months of the year. In the illustrated example, the hour marker 204 shows "8" at the top of the dial 202 reflecting that it is currently 4:45 o'clock, on a day in the month of August.

Figure 6:
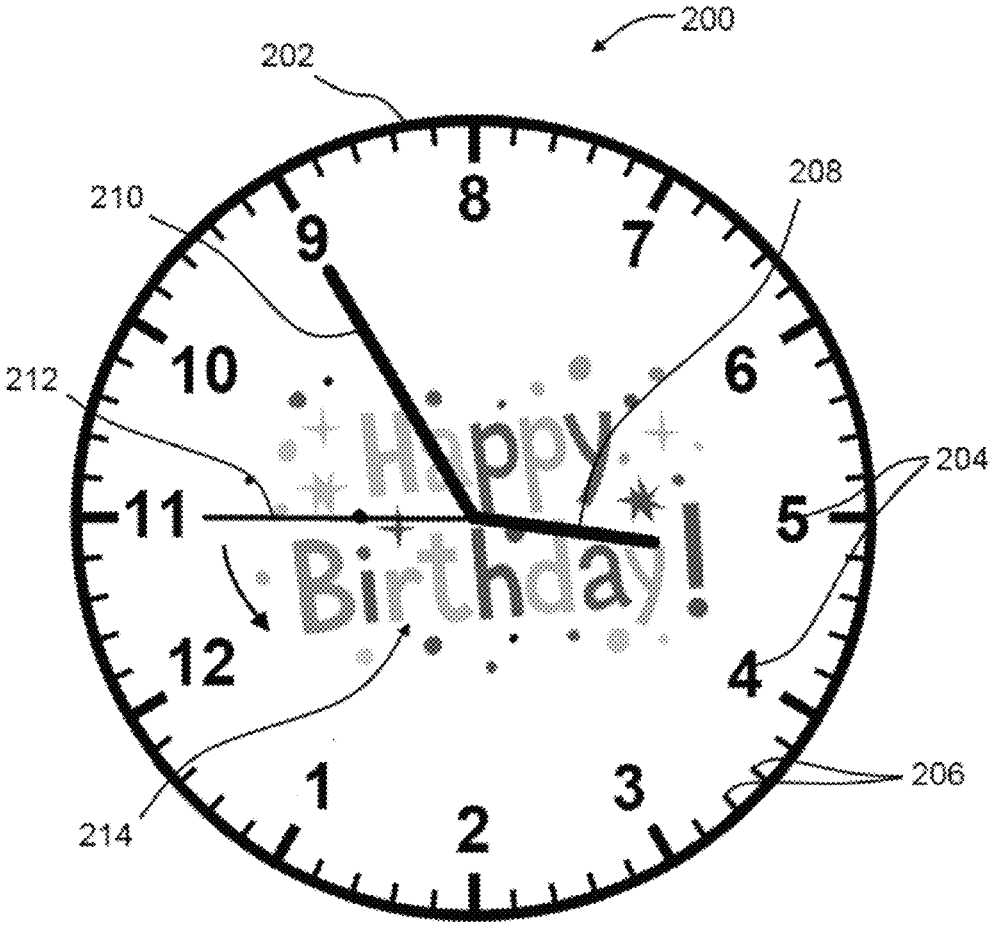
FIG. 6 illustrates the clock face showing a predetermined month and image.

Referring to FIG. 6, a preferred embodiment of the alternative embodiment clock face is shown wherein the dial 202 reflects the current month. This embodiment presumes a clock face 200 dedicated as a birthday gift. In such an embodiment, an indicia 214, such as a birthday message as illustrated is placed on the dial 202. Since the clock face 200 is dedicated for a specific purpose, the dial 202 may be immovable, remaining with the recipient's birth month at the primary hour marker 204. Alternatively, the dial 202 may rotate with each month, causing the indicia 214 to align correctly when the recipient's birth month arrives.

Figure 7:
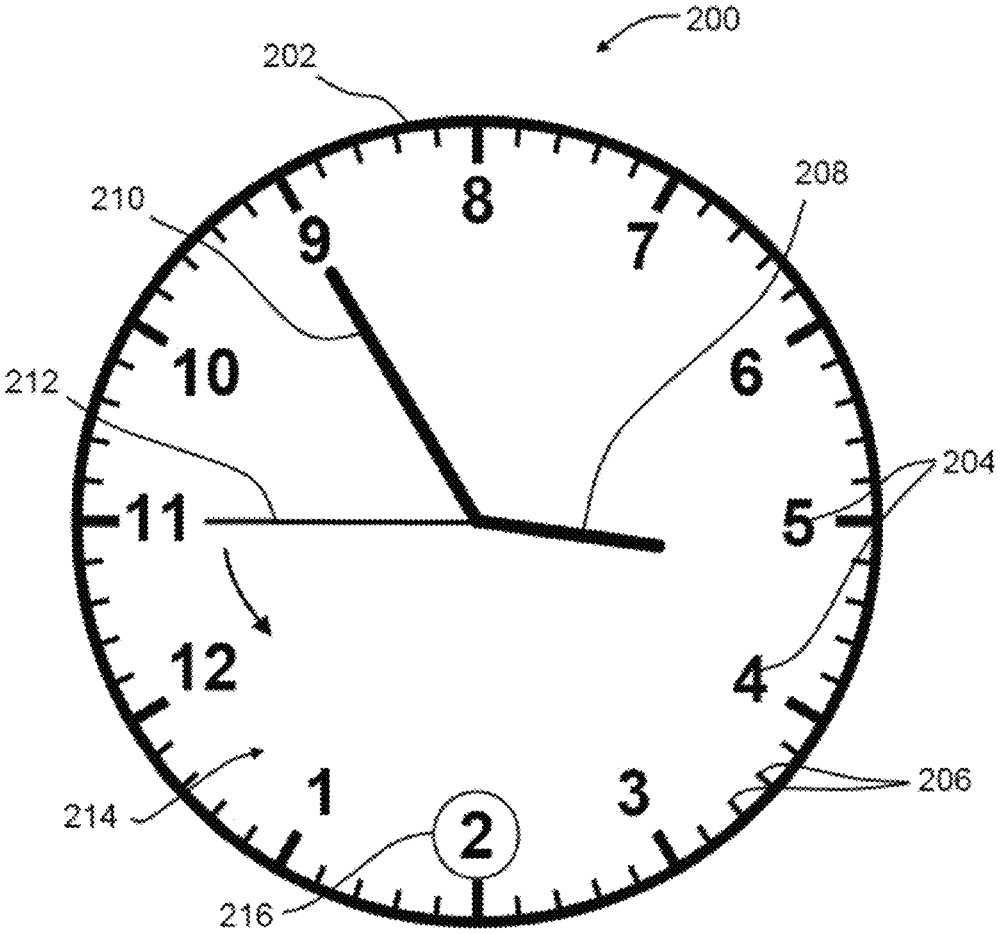
FIG. 7 illustrates the clock face showing a day of the week.

Referring to FIG. 7, the alternative embodiment clock face 200 is shown with the hour hand 208 and minute hand 210 reflecting 4:45 o'clock and the dial 202 reflecting the month of August. In this embodiment the day of the week is also shown, with the hour markers "1" through "7" reflecting Sunday through Saturday, respectively. In countries using calendars with weeks beginning on a Monday, the hour markers "I" through "7" would represent the days Monday through Sunday, respectively. In the illustrated embodiment, the hour marker 204 corresponding to the present day is surrounded by a circle 216. The illustrated clock face 200 therefore shows that it is 4:45 o'clock on a Tuesday in August. In an alternative embodiment, circles may be omitted, and the dial 202 may change color to reflect the day of the week. The circles and colors can also be combined, so that when an hour marker 204 is circled, a corresponding color is shown.

In the color-changing embodiment, it is anticipated that the colors will be arranged along the color spectrum, so that they appear to go through the colors of a rainbow. For example, on Sunday the dial may be red and the hour marker 204 "1" circled. Proceeding through the days of the week; on Monday the "2" will be circled and the dial will be orange, on Tuesday the "3" will be circled and the dial will be yellow, on Wednesday the "4" will be circled and the dial will be green, on Thursday the "5" will be circled and the dial will be baby blue, on Friday the "6" will be circled and the dial will be blue, and on Saturday, the "7" will be circled and the dial will be violet. This arrangement can be calibrated according to U.S. and European calendar models (i.e., beginning on a Sunday or beginning on a Monday, respectively). With these options in mind, the following tables show respective hour markers 204, days and colors:

| U.S. | | | European | | |
|---|---|---|---|---|---|
| 1 | Sunday | Red | 1 | Monday | Orange |
| 2 | Monday | Orange | 2 | Tuesday | Yellow |
| 3 | Tuesday | Yellow | 3 | Wednesday | Green |
| 4 | Wednesday | Green | 4 | Thursday | Baby Blue |
| 5 | Thursday | Baby Blue | 5 | Friday | Blue |
| 6 | Friday | Blue | 6 | Saturday | Violet/Purple |
| 7 | Saturday | Violet/Purple | 7 | Sunday | Red |

Importantly, while the present invention requires an analog-type, conventional clock face, the clock face may be mechanical, incorporated into a physical clock, or may be a graphical representation on a screen on an electronic device. When incorporated into a physical clock, the movement of the clock face 200 create an interesting motion that attracts the attention of a viewer, and draws the viewer's attention to the indicia present on the dial 202. When incorporated into an electronic device, the clock face 200 may be programmed with multiple settings, so that a user can set the clock face 200 to have a turning dial 202, display a message on the dial 202, set the dial 202 to a predetermined month, and turn on and off day of the week circles 216 or colors.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A clock face for displaying current time, the clock face comprising an analog-type clock face having a dial bearing at least one hour marker relative to one of twelve hours;

an hour hand and a minute hand, the hour hand and the minute hand configured for counter-clockwise travel;

a position of the hour hand reflecting a current hour and the minute hand configured to reflect a current minute within the hour;

the dial movable in a clockwise direction to display the at least one hour marker so that the at least one hour marker corresponds to a current month; and wherein the hour hand and the minute hand move in a counter-clockwise direction, and the dial spins in a clockwise direction to show the current time and current month.

2. The clock face of claim 1 further comprising a second hand traveling in a counter-clockwise direction to display the current time to the second.

3. The clock face of claim 1 further comprising a circle around an hour marker, the hour marker corresponding to a particular day of the week.

4. The clock face of claim 1 wherein the dial changes a different color for each day of the week.

5. The clock face of claim 1 wherein the clock face is incorporated into a mechanical clock.

6. The clock face of claim 1 wherein the clock face is an animated graphic shown on an electronic screen.

7. The clock face of claim 1 wherein the dial is set to a predetermined hour indicator other than twelve.

8. A clock face for displaying a current time, the clock face comprising an analog-type clock face having a dial, the dial bearing an indicia for displaying twelve hours;

hour markers corresponding to the twelve hours arranged around the dial, the hour markers arranged in a counter-clockwise numerical sequence;

an hour hand and a minute hand configured to travel in the counter-clockwise direction around the dial, the hour hand reflecting the current hour proximate each hour marker, and the minute hand configured to reflect a minute in the hour;

the dial moving in a clockwise direction to display the hour marker corresponding to a current month at a top of the clock face;

the dial identifying a day of the week; and wherein as the hour hand and the minute hand move in the counter-clockwise direction, the dial spins in the clockwise direction to cause the clock face to show the current time and current month.

9. The clock face of claim 8, wherein the dial moves continuously and is calibrated so the hour marker indicating a next month reaches the top of the clock face on a first day of the next month.

10. A clock face for displaying a current time, the clock face comprising an analog-type, circular clock face having a dial, the dial bearing an indicia for displaying twelve hours;

hour markers corresponding to the twelve hours arranged around the dial, the hour markers arranged in a counter-clockwise numerical sequence;

an hour hand and a minute hand configured to travel in a counter-clockwise direction around the dial, a position of the hour hand reflecting a current time proximate each hour marker, and a position of the minute hand configured to reflect a minute of an hour;

the dial movable in a clockwise direction to display an hour marker corresponding to a current month at a top of the clock face;

the dial having an indicia with an orientation, the indicia oriented to a predetermined hour marker, thereby displaying the indicia in a particular manner during a predetermined month; and wherein the hour hand and the minute hand move in a counter-clockwise direction, and the dial spins in a clockwise direction to show the current time and current month.

* * * * *